United States Patent [19]

Stenberg et al.

[11] 4,412,793

[45] Nov. 1, 1983

[54] PUMP INCLUDING LOCKING MEANS FOR A FLEXIBLE TUBE

[75] Inventors: Kaj O. Stenberg, Staffanstorp; Lars H. Nyström, Veberod, both of Sweden

[73] Assignee: Cambro Lundia AB, Sweden

[21] Appl. No.: 315,924

[22] Filed: Oct. 28, 1981

[30] Foreign Application Priority Data

Nov. 6, 1980 [SE] Sweden ..... 8007803

[51] Int. Cl.[3] ..... F04B 43/12

[52] U.S. Cl. ..... 417/477

[58] Field of Search ..... 417/474–480; 138/106; 24/257, 349, 260, 19

[56] References Cited

U.S. PATENT DOCUMENTS 485,484 11/1892 Arnold ..... 24/19
3,138,104 6/1964 Cantor ..... 417/477
3,567,345 3/1971 Ballentine ..... 417/477
3,885,894 5/1975 Sikes ..... 417/477
4,231,725 11/1983 Hogan ..... 417/477

FOREIGN PATENT DOCUMENTS 1519415 7/1978 United Kingdom ..... 417/477

*Primary Examiner*—Richard E. Gluck
*Attorney, Agent, or Firm*—Lerner, David, Littenberg, Krumholz & Mentlik

[57] ABSTRACT

A pump for pumping a fluid through a flexible tube is disclosed including a housing having an inlet and an outlet, in which the inlet and outer include seats for retaining the flexible tube, and including an adjustable lock for locking the flexible tube against these seats at the inlet and outlet. This is preferably accomplished by a common actuator for simultaneously adjusting the locks at both the inlet and the outlet.

15 Claims, 3 Drawing Figures

PUMP INCLUDING LOCKING MEANS FOR A FLEXIBLE TUBE

FIELD OF THE INVENTION

The present invention relates to pumps including a flexible tube arranged in a path between an inlet and an outlet. More particularly, the present invention relates to locking means for locking the flexible tube at the inlet and outlet of the pump. Still more particularly, the present invention relates to an improved locking means for locking a tube specifically in connection with heart-/lung machine pumps.

BACKGROUND OF THE INVENTION

In those previously known devices of the type described above, the flexible tube is usually locked by means of specially designed inserts which are adapted to lock the tube against a seat located at the inlet and outlet, respectively. Such inserts are usually mounted on the pump by means of some form of screw joint, and are generally dimensioned such that they can only fit a single tube dimension at a time. Examples of known devices for locking the flexible tube are those shown in U.S. Pat. Nos. 3,791,777 and 4,025,241. In the former case, a plurality of tubes are clasped by means of separate stud bolts 25, and in the latter case the tubes are clasped by means of abutments 104 and 105 with lips 41 and 44 so as to prevent longitudinal movement of the tubing.

A serious drawback with these known inserts is that they must necessarily be exchanged whenever there is a change of tube dimension. Such an exchange is not only time consuming, but it also generally requires some sort of tool in order to loosen the screw joint. Such exchanges are therefore especially troublesome in connection with heart/lung machine pumps, where one is often required to change tube dimensions depending on the desired range of flow.

The object of the present invention is therefore to provide a pump which requires neither an exchange of inserts nor the use of special tools in connection with any change in tube dimension.

SUMMARY OF THE INVENTION

In accordance with the present invention, a pump is provided for pumping a fluid through a flexible tube including a housing for at least a portion of the flexible tube, the housing including an inlet, an outlet, and means for transporting the fluid in the flexible tube from the inlet to the outlet, and the inlet and the outlet including seat means for retaining the flexible tube, and the pump including adjustable locking means for adjustably locking the flexible tube against the seat means.

In accordance with a preferred embodiment of the pump of the present invention, the adjustable locking means comprises moveably adjustable organs or slides which are adapted to lock the tube against the respective seat means. The adjustable locking means thus preferably comprise a pair of slidable members slidably moveable towards the seat means at the inlet and the outlet, respectively, whereby the flexible tube can be adjustably retained between the slidable members and the seat means at both the inlet and the outlet.

In accordance with another embodiment of the pump of the present invention, the adjustable locking means includes common rod means having a first end and a second end, and each of the pair of slidable members or organs are mounted at the first and second ends of the common rod means, respectively. Preferably, the first and second ends of the common rod means are threaded, and the pair of slidable members include corresponding internal threads, whereby upon the rotation of the common rod means the slidable members are caused to move slidably by the cooperation of the threaded ends of the common rod member with the internal threads of the slidable members. Preferably, the pump also includes rotation means for rotating the common rod means, such as a wheel member affixed to the central portion of a common rod means, whereby rotation of the wheel member causes corresponding rotation of the common rod means.

According to another embodiment of the pump of the present invention, the adjustable locking means includes an arcuate or cup-shaped surfaces facing the seat means, whereby the flexible tube can be retained between the seat means and the arcuate surface of the locking means. Thus, the flexible tube is evenly surrounded upon locking thereof.

In accordance with another embodiment of the pump of the present invention, the seat means also includes an arcuate or cup-shaped surface facing the adjustable locking means, whereby the flexible tube may be retained between the locking means and the arcuate surface of the seat means, again thereby permitting the entire tube to be surrounded in connection with the locking thereof.

In accordance with a preferred embodiment of this aspect of the pump of the present invention, the adjustable locking member includes an upper surface and a lower surface, with the arcuate surface therebetween, and wherein the lower surface of the adjustable locking means includes an extended portion facing the seat means whereby the extended portion is closer to the seat means than either the arcuate portion or the upper surface of the adjustable locking means. In this manner, the tube can be guided toward the corresponding cup-shaped or arcuate surface of the associated seat. This embodiment is especially advantageous in connection with tubes of small dimensions.

In accordance with another embodiment of the pump of the present invention, there is provided a pump for pumping a fluid through a flexible tube comprising a housing for at least a portion of the flexible tube, the housing including an inlet, an outlet, and means for transporting said fluid within the flexible tube from the inlet to the outlet, adjustable locking means for locking the flexible tube in a fixed position at the inlet and the outlet, and common actuation means for simultaneously adjusting the adjustable locking means at both the inlet and the outlet.

In accordance with one embodiment of this aspect of the pump of the present invention, the inlet and outlet include seat means, whereby the flexible tube can be retained and locked between the seat means and the adjustable locking means.

BRIEF DESCRIPTION OF THE DRAWINGS

The present invention can be more fully understood with reference to the accompanying drawings, in which.

DETAILED DESCRIPTION

Figure 1:
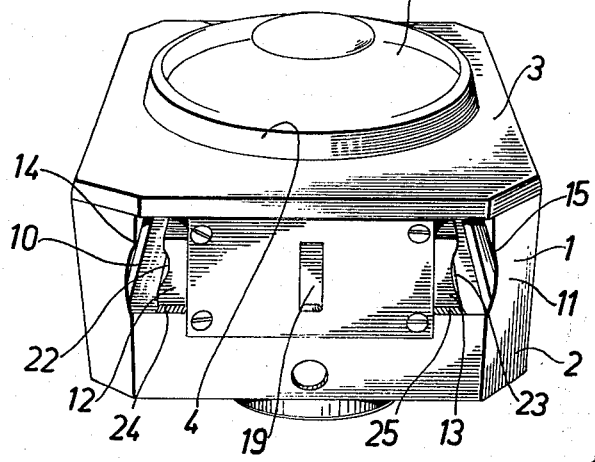
FIG. 1 is a front, perspective, elevational view of a preferred embodiment of the pump of the present invention.
Figure 2:
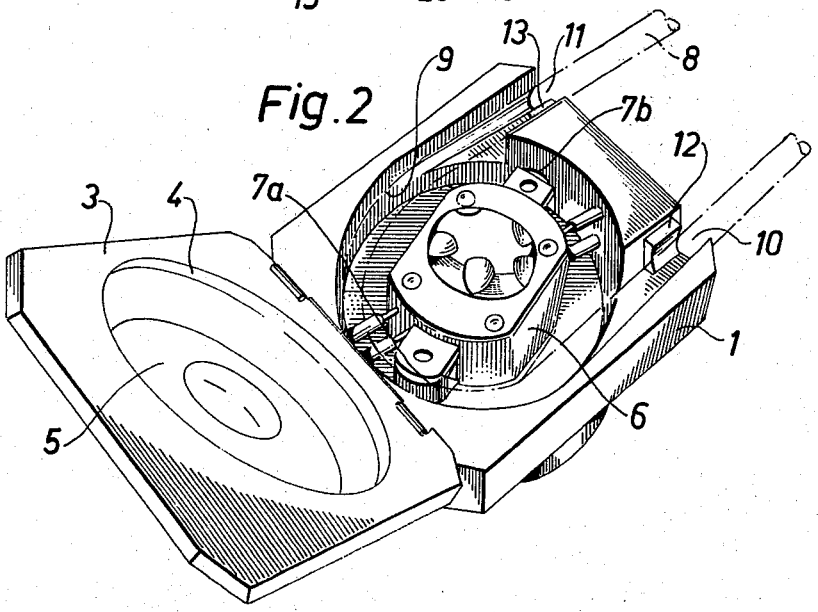
FIG. 2 is a top, elevational, perspective view of a pump of FIG. 1, with its lid in the open position.

Referring to the figures, in which like numerals refer to like portions thereof, in FIGS. 1 and 2 there is shown a pump according to the present invention conveniently housed in an essentially rectangular box 1 comprising a cup-shaped bottom portion 2 and an openable and closable lid 3.

Preferably, the lid 3 has a central opening 4 which may, for example, be covered by a transparent plastic cover 5, so that it is possible to supervise the pump without the need to open lid 3.

Centrally located in the cup-shaped bottom portion 2 is a rotatable rotor 6, which can, for example, comprise two or more circumferentially located rollers *7a, 7b*. These rollers are adapted to compress the tube 8 against the inner wall 9 of the cup-shaped bottom portion 2, so as to pump liquid contained in the tube from inlet 10 to outlet 11.

According to this invention, the pump thus includes a flexible tube 8 arranged in a path between the inlet 10 and outlet 11, and locking means to lock the tube at both the inlet and outlet, respectively.

As suggested in FIGS. 1 and 2, this locking means comprises two moveable organs 12 and 13 in the form of slides, which are adapted to alternately move towards and from seats 14 and 15, respectively, that is at the inlet 10 and the outlet 11, as will be described in more detail with reference to FIG. 3.

Figure 3:
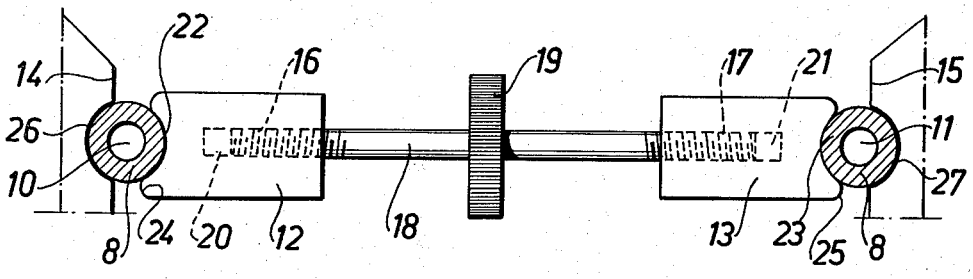
FIG. 3 is a front, partially sectional, partially schematic view of a preferred embodiment of the locking means for use in connection with the pump of FIGS. 1 and 2.

Referring to FIG. 3, an especially preferred embodiment of the locking means is shown therein for locking the tube in the pump as shown in FIGS. 1 and 2, for example. According to this embodiment, these slides 12 and 13 are mounted at the respective ends 16 and 17 of a common rod 18, and are moveable towards and from, respectively, the seats 14 and 15 by rotation of the rod 18 means of a centrally located wheel 19.

As suggested in the broken lines shown in FIG. 3, these slides 12 and 13 are provided with an internally threaded seat 20, 21 for receiving of a corresponding threaded end 16 and 17, respectively, of the rod 18. Thus, if one end 16 of the rod is clockwisely threaded, and the other end 17 is counterclockwisely threaded, the slides 12 and 13 will thereby simultaneously move either towards or away from their respective seats, 14 and 15, for locking and releasing the tube 8 at inlet 10 and outlet 11.

From FIG. 3 it can also be seen that the respective surface 22 and 23 of slides 12 and 13, which are facing the tube 8, are cup-shaped, and each of these cup-shaped surfaces includes extended lower edges 24 and 25, respectively, which are intended to lift and guide the tube 8 towards the corresponding cup-shaped sides 26 and 27 of seats 14 and 15, respectively.

The rotor 6 shown in FIGS. 1 and 2 is preferably rotated by means of a motor (not shown) via a drive shaft (not shown) which is received in the bottom portion of the rotor through a suitable bearing.

The pumps according to this invention are especially adapted for use in connection with heart/lung machines, but it is also suitable in other applications where it is often necessary to change tube dimensions, depending upon the desired flow range.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

What is claimed is:

1. A pump for pumping a fluid through a flexible tube comprising a housing for at least a portion of said flexible tube, said housing including an inlet, an outlet, and means for progressively deforming said flexible tube from said inlet to said outlet for transporting said fluid therethrough, said inlet and said outlet including seat means for retaining said flexible tube, and said pump further including adjustable locking means mounted between said seat means for adjustably locking said flexible tube against said seat means, said adjustable locking means including common rod means having a first end and a second end, and a pair of slidable members mounted at said first and second ends of said common rod means, respectively, said pair of slidable members being simultaneously slidably movable towards said seat means at said inlet and said outlet, respectively, whereby said flexible tube may be adjustably retained between said slidable members and said seat means at said inlet and said outlet.

2. The pump of claim 1 wherein said first and second ends of said common rod means are threaded, and wherein said pair of slidable members include corresponding internal threads, whereby upon the rotation of said common rod means said slidable members are caused to move slidably towards said seat means by the cooperation of said threaded ends of said common rod means with said internal threads of said slidable members.

3. The pump of claim 2 including rotation means for rotating said common rod means.

4. The pump of claim 3 wherein said rotation means comprises a wheel member affixed to the central portion of said common rod means, whereby rotation of said wheel member causes corresponding rotation of said common rod means.

5. The pump of claim 1 wherein said adjustable locking means includes an arcuate surface facing said seat means whereby said flexible tube may be retained between said seat means and said arcuate surface of said adjustable locking means.

6. The pump of claim 1 or 5 wherein said seat means includes an arcuate surface facing said adjustable locking means whereby said flexible tube may be retained between said adjustable locking means and said arcuate surface of said seat means.

7. The pump of claim 5 wherein said adjustable locking means includes an upper surface and a lower surface, with said arcuate surface therebetween, and wherein said lower surface of said adjustable locking means includes an extended portion facing said seat means whereby said extended portion is closer to said seat means than either said arcuate surface or said upper surface of said adjustable locking means.

8. A pump for pumping a fluid through a flexible tube comprising a housing for at least a portion of said flexible tube, said housing including an inlet, and outlet, and means for progressively deforming said flexible tube from said inlet to said outlet for transporting said fluid therethrough, said inlet and said outlet including seat means, adjustable locking means mounted between said inlet and said outlet for locking said flexible tube in a fixed position at said inlet and said outlet, and common actuation means for simultaneously adjusting said adjustable locking means in opposite directions at both said inlet and said outlet, said common actuation means including a first end and a second end, a first locking member mounted at said first end of said common actuation means and a second locking member mounted at said second end of said common actuation means, whereby said flexible tube may be retained between said seat means and said adjustable locking means at both said inlet and said outlet.

9. The pump of claim 8 wherein said common actuation means comprises a common rod means.

10. The pump of claim 9 wherein said first and second ends of said common rod means are threaded, and wherein said pair of locking members include corresponding internal threads, whereby upon the rotation of said common rod means said locking members are caused to move slidably in opposite directions towards said seat means by the cooperation of said threaded ends of said common rod means with said internal threads of said locking members.

11. The pump of claim 10 wherein said common actuation means includes rotation means for rotating said common rod means.

12. The pump of claim 11 wherein said rotation means comprises a wheel member affixed to the central portion of said common rod means, whereby rotation of said wheel member causes corresponding rotation of said common rod means.

13. The pump of claim 8 wherein said adjustable locking means includes an arcuate surface facing said seat means whereby said flexible tube may be retained between said seat means and said arcuate surface of said adjustable locking means.

14. The pump of claim 8 or 17 wherein said seat means includes an arcuate surface facing said adjustable locking means whereby said flexible tube may be retained between said adjustable locking means and said arcuate surface of said seat means.

15. The pump of claim 13 wherein said adjustable locking means includes an upper surface and a lower surface, with said arcuate surface therebetween, and wherein said lower surface of said adjustable locking means includes an extended portion facing said seat means whereby said extended portions is closer to said seat means than either said arcuate surface or said upper surface of said adjustable locking means.

* * * * *

UNITED STATES PATENT AND TRADEMARK OFFICE

CERTIFICATE OF CORRECTION

PATENT NO. : 4,412,793
DATED : November 1, 1983
INVENTOR(S) : Stenberg, et al

It is certified that error appears in the above-identified patent and that said Letters Patent are hereby corrected as shown below:

On the first page, the assignee "Cambro" should read --Gambro--.

Column 6, line 14, "17" should read --13--.

Signed and Sealed this

*Nineteenth* Day of *June 1984*

[SEAL]

*Attest:*

GERALD J. MOSSINGHOFF

*Attesting Officer*

*Commissioner of Patents and Trademarks*